US012753671B2

(12) United States Patent
Taylor et al.

(10) Patent No.: US 12,753,671 B2
(45) Date of Patent: Oct. 6, 2026

(54) RETRIEVABLE PACKER ELEMENT—ANTI EXTRUSION BARRIER

(71) Applicant: Expro North Sea Limited, Aberdeenshire (GB)

(72) Inventors: Robert Justyn Taylor, Houston, TX (US); Seth J. Fadaol, Youngsville, LA (US)

(73) Assignee: Expro North Sea Limited, Aberdeenshire (GB)

( * ) Notice: Subject to any disclaimer, the term of this patent is extended or adjusted under 35 U.S.C. 154(b) by 0 days.

(21) Appl. No.: 19/284,807

(22) Filed: Jul. 30, 2025

(65) Prior Publication Data

US 2026/0036014 A1 Feb. 5, 2026

Related U.S. Application Data

(60) Provisional application No. 63/678,406, filed on Aug. 1, 2024.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1216; E21B 33/128
See application file for complete search history.

(56) References Cited

U.S. PATENT DOCUMENTS

| | | | | |
|---|---|---|---|---|
| 2,555,647 | A * | 6/1951 | King | E21B 33/1216 277/543 |
| 6,102,117 | A * | 8/2000 | Swor | E21B 33/1216 166/138 |
| 7,316,271 | B2 | 1/2008 | Moyes | |
| 7,696,275 | B2 | 4/2010 | Slay et al. | |
| 8,459,347 | B2 | 6/2013 | Stout | |
| 2002/0043368 | A1* | 4/2002 | Bell | E21B 33/1216 166/134 |
| 2003/0226659 | A1* | 12/2003 | Smith | E21B 33/1204 166/134 |
| 2011/0259610 | A1* | 10/2011 | Shkurti | E21B 33/12 166/318 |
| 2022/0081991 | A1* | 3/2022 | Deng | E21B 33/128 |

* cited by examiner

*Primary Examiner* — George S Gray
(74) *Attorney, Agent, or Firm* — Patterson + Sheridan, LLP

(57) ABSTRACT

A packer assembly includes a tubular body, a mandrel circumferentially surrounding the tubular body, a gauge ring, an anti-extrusion ring, a force ring, and a packer element. The anti-extrusion ring includes a first ring comprising a plurality of first ring segments, a second ring comprising a plurality of second ring segments, a spring disposed in a spring channel, and a plurality of retention bolts. Each first ring segment includes a first ring segment spring channel and a retention bolt connector. Each second ring segment includes a second ring segment spring channel and a retention bolt expansion channel formed through the second ring. The spring channel comprises the first ring segment spring channels and the second ring segment spring channels. The retention bolts are disposed in the retention bolt expansion channel and coupled to the retention bolt connector.

19 Claims, 14 Drawing Sheets

RETRIEVABLE PACKER ELEMENT—ANTI EXTRUSION BARRIER

CROSS-REFERENCE TO RELATED APPLICATIONS

This application claims priority to U.S. Provisional Patent Application No. 63/678,406, filed Aug. 1, 2024, which is herein incorporated by reference in its entirety.

BACKGROUND

Field

Embodiments of the present disclosure generally relate to downhole packers, downhole packer assemblies and downhole tools employing packers and packer assemblies.

Description of the Related Art

In the resource recovery industry, more specifically in hydrocarbon recovery, sealing tools such as bridge plugs and packer elements are used to isolate production zones to control downhole pressure and fluids. Packers, temporary or permanent, include packer elements that provide a seal to prevent fluid flow from the zones downstream from the packer element to the zones upstream of the packer element. During operation, an upper gauge ring and a lower gauge ring of a packer compress the packer element such that the packer element expands radially outwards towards the surrounding casing. The expansion results in the packer contacting the casing and creating a seal between the upstream zone and downstream zone of the casing.

However, packer elements are prone to extrusion under high pressure and force. Failure of the packer elements due to extrusion may compromise the seal between the upstream zone and the downstream zone. Anti-extrusion rings have been utilized to minimize extrusion of the packer element at high pressures. Current retrievable packer systems are comprised of springs intended to help with the uniform compression and expansion of segments and allow retrieval of packer systems. However, current anti-extrusion devices are sometimes vulnerable to failure, compromising the effectiveness of the anti-extrusion ring. In particular, contamination of the area around the spring may lead to spring failure, which in turn leads to failure of the anti-extrusion ring. Failure of the anti-extrusion ring may result in pieces of the anti-extrusion ring falling downhole, making the pieces irretrievable, and hampering the retrievability of the packet elements.

Therefore, there is a need for improved packer and packer systems which prevent or minimize destructive extrusion of packer elements.

SUMMARY

In one embodiment, a packer assembly with an anti-extrusion ring is disclosed. The anti-extrusion ring includes a first ring comprising a plurality of first ring segments, a second ring comprising a plurality of second ring segments, a spring disposed in a spring channel, and a plurality of retention bolts. Each first ring segment of the plurality of first ring segments includes a first ring segment spring channel and a retention bolt connector. Each second ring segment of the second ring segments includes a second ring segment spring channel and a retention bolt expansion channel formed through the second ring. The spring channel includes the first ring segment spring channels and the second ring segment spring channels. The retention bolts are disposed in the retention bolt expansion channel and coupled to the retention bolt connector.

In another embodiment, a packer system is disclosed. The packer assembly includes a tubular body, a mandrel circumferentially surrounding the tubular body, a gauge ring, an anti-extrusion ring, a force ring, and a packer element. The anti-extrusion ring includes a first ring comprising a plurality of first ring segments, a second ring comprising a plurality of second ring segments, a spring disposed in a spring channel, and a plurality of retention bolts. Each first ring segment of the plurality of first ring segments includes a first ring segment spring channel and a retention bolt connector. Each second ring segment of the second ring segments includes a second ring segment spring channel and a retention bolt expansion channel formed through the second ring. The spring channel comprises the first ring segment spring channels and the second ring segment spring channels. The retention bolts are disposed in the retention bolt expansion channel and coupled to the retention bolt connector.

In yet another embodiment, a method of isolating a region downhole between packer assemblies is disclosed. The method includes deploying a packer system comprising a packer assembly in a casing. A force is applied to an anti-extrusion ring of the packer assembly using a gauge ring of the packer assembly. The anti-extrusion ring a first ring comprising a plurality of first ring segments, a second ring comprising a plurality of second ring segments, a spring disposed in a spring channel, and a retention bolt coupling the first ring and the second ring. Applying the force to the anti-extrusion ring expands the anti-extrusion ring and a packer element radially outward and forms a seal against the casing with the packer element.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to downhole packers, downhole packer assemblies and downhole tools employing packers and packer assemblies. More specifically the present disclosure relates to a packer assembly having a retractable anti-extrusion ring disposed adjacent an upper and a lower surface of one or more packer elements disposed on a packer system.

Figure 1A:
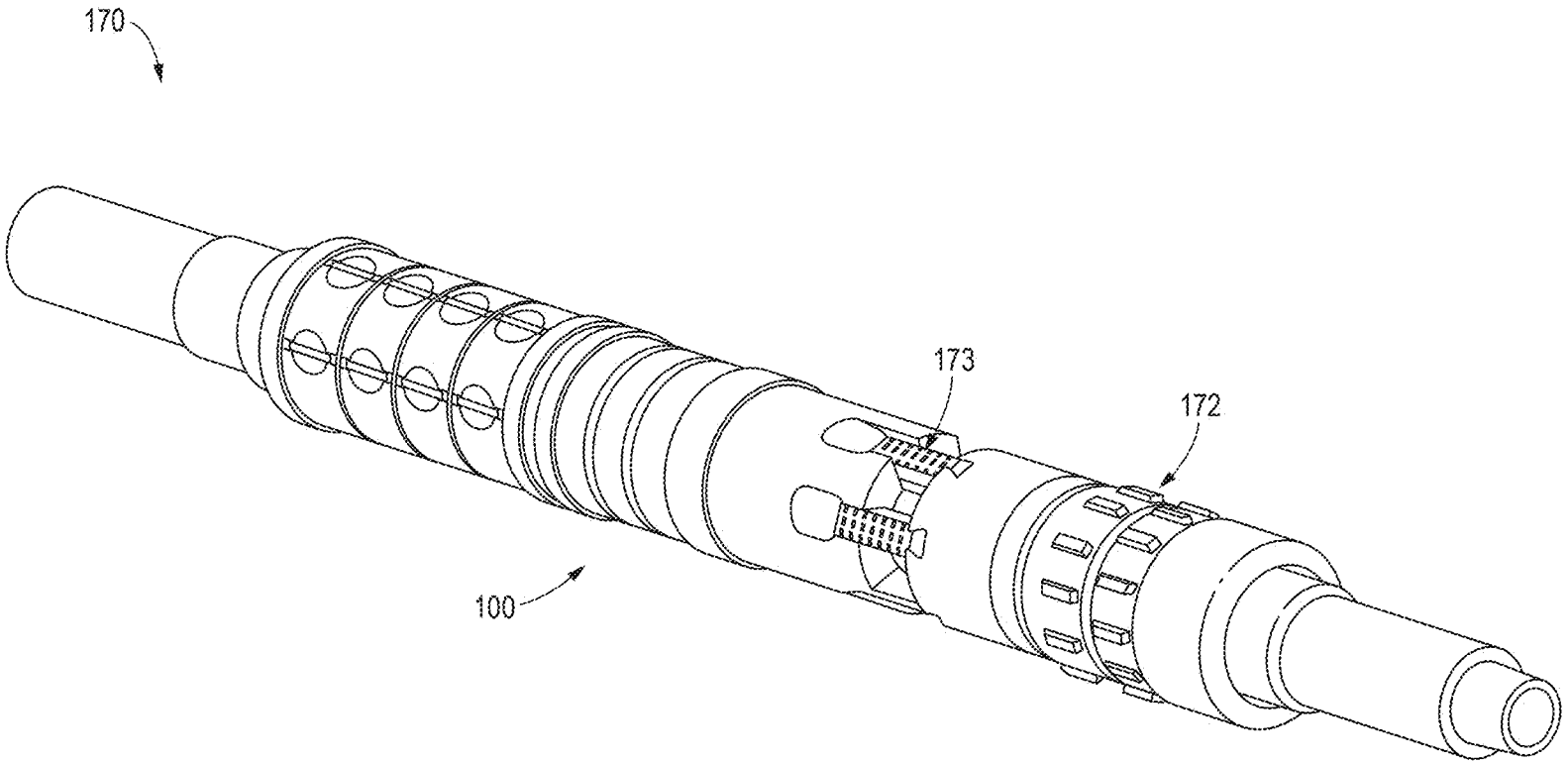
FIG. 1A is a perspective view of a packer system, according to embodiments herein.

FIG. 1A is a perspective view of a packer system 170. The packer system 170 may be the BRUTE® Retrievable Service Packer from EXPRO. The packer assembly 100 is run into the wellbore to reach a desired region in the wellbore for which isolation is desired. The packer system 170 may be attached to tubing both upstream and downstream of the packer system 170 to run the packer system 170 to the desired depth in the wellbore. In some applications, a series of packer systems 170 may be utilized to isolate multiple reservoirs or regions in the wellbore at various depths. The packer system 170 includes a packer assembly 100 and a drag block section 172. The drag block section 172 provides the friction required to start the setting process of the packer system 170. A tool (not shown) brings the packer system 170 into tension and rotates the packer system 170 into a set position. The tool then applies an axial force to the packer system 170, causing slips 173 to extend radially outward and grip the inner surface of the casing surrounding the packer system 170. Simultaneously, the same axial force causes the packer assembly 100 to expand radially outward and form a seal against the casing.

Figure 1B:
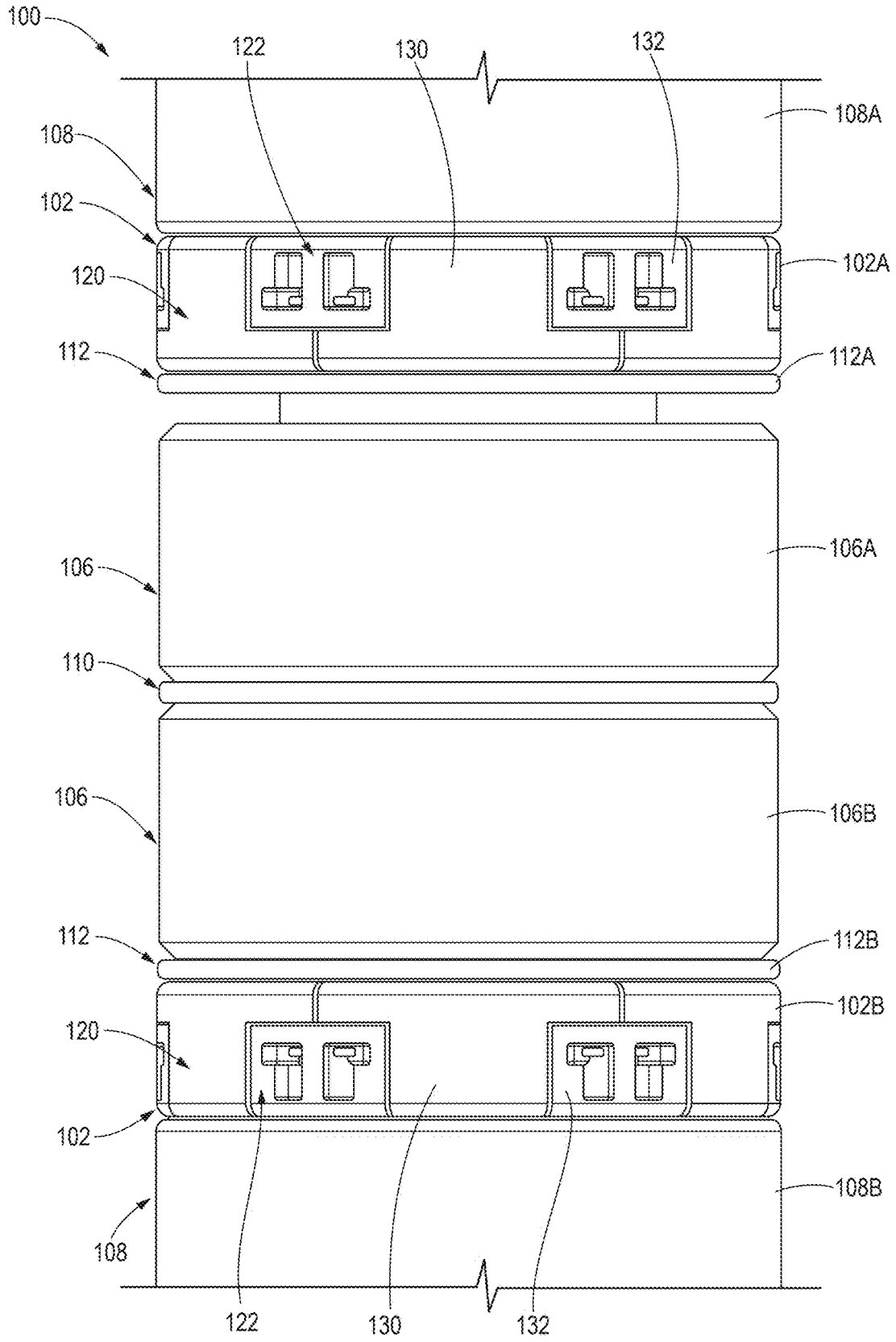
FIG. 1B is a perspective view of a downhole packer assembly on a packer system having an anti-extrusion ring in an uncompressed position disposed thereon, according to embodiments herein.
Figure 1C:
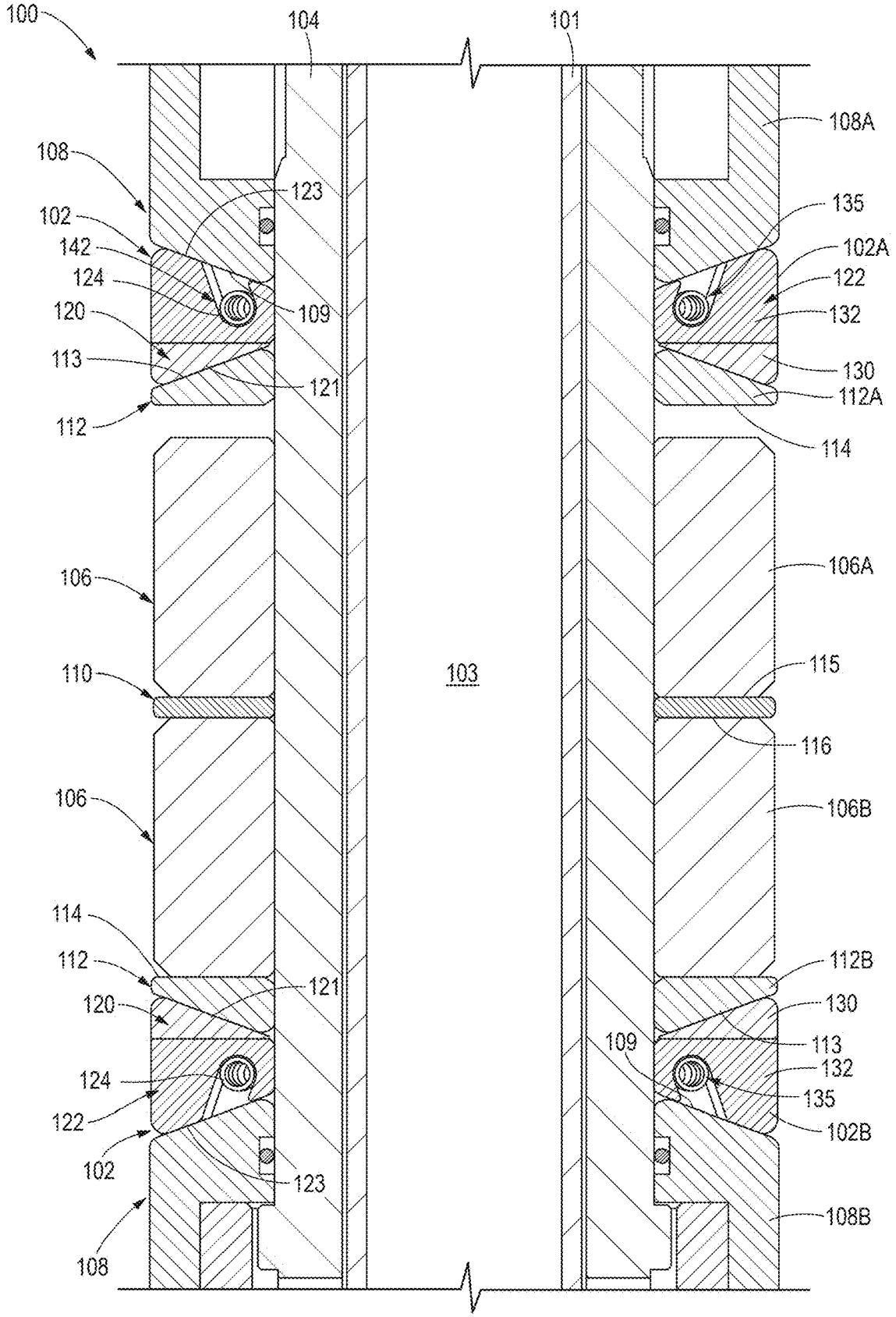
FIG. 1C is a cross-sectional view of a packer assembly having the anti-extrusion ring in the uncompressed position disposed thereon, according to embodiments herein.

FIG. 1B is a perspective view of the downhole packer assembly 100 on the packer system 170 having an anti-extrusion ring 102 in an uncompressed position disposed on an upper and lower end of the packer assembly 100. FIG. 1C is a cross sectional view of the packer assembly 100 of FIG. 1B in the uncompressed position. The packer assembly 100 includes a tubular body 101, one or more anti-extrusion rings 102 (e.g., an upper (or first) anti-extrusion ring 102A and lower (or second) anti-extrusion ring 102B), a mandrel 104 circumferentially surrounding the tubular body 101, one or more packer elements 106 (e.g., an upper packer element 106A and a lower packer element 106B), one or more gauge rings 108 (e.g., a first or upper gauge ring 108A and a second or lower gauge ring 108B), a separator 110, and one or more force rings 112 (e.g. a first or upper force ring 112A and a second or lower force ring 112B). The tubular body 101 defines a fluid flow/pumping volume 103. Generally, the term "upper" refers to component that is disposed upstream on the packer system 170, while the term "lower" refers to a component that is disposed downstream on the packer system 170.

The anti-extrusion rings 102 include an inner ring 120 (e.g., a first ring), an outer ring 122 (e.g., a second ring), and a spring 124. The anti-extrusion rings 102 circumferentially surround the mandrel 104. Generally, the term "inner" refers to a direction closer to the separator 110, while the term "outer" refers to a direction further from the separator 110. The inner ring 120 includes a plurality of inner ring segments 130 and the outer ring 122 includes a plurality of outer ring segments 132. Each inner ring segment 130 includes an inner ring segment spring channel 140 and each outer ring segment 132 includes an outer ring segment spring channel 142. A spring channel 135 is formed from a plurality of the inner ring segment spring channels 140 and the plurality of the outer ring segment spring channels 142. When assembled, the inner ring segment spring channels 140 and the outer ring segment spring channels 142 are aligned to form the spring channel 135. The spring channel 135 includes an opening on the outer side of the spring 124. The spring channel 135, in conjunction with the gauge rings 108, surrounds (e.g., fully contains) the spring 124. The spring channel 135 houses the spring 124 and protects the spring 124 from contamination under production conditions, e.g., the spring channel 135 prevents potential spring failure due to debris intrusion. In some embodiments, the spring 124 is a single continuous spring. In other embodiments, the spring 124 is a series of springs.

The inner ring 120 includes an inner angled surface 121 and the outer ring 122 includes an outer angled surface 123. The outer angled surface 123 of the outer ring 122 is in contact with an inner angled surface 109 of the gauge rings 108. Each force ring 112 includes an outer angled surface 113 and an inner flat surface 114. The outer angled surface 113 of the force ring 112 is in contact with the inner angled surface 121 of the inner ring 120 of the anti-extrusion ring 102.

The separator 110 is disposed between the upper (or first) packer element 106A and the lower (or second) packer element 106B while in the uncompressed position. The packer elements 106 include an elastomeric material. The force rings 112 are disposed between the one or more packer elements and the anti-extrusion rings 102 while in the uncompressed position. A force (e.g., the tailpipe force applied by the tool) is applied to the anti-extrusion rings 102 via the gauge rings 108 which moves the anti-extrusion rings 102 from the uncompressed position to the compressed position. When the force is applied to the anti-extrusion rings 102 by the gauge ring 108, the outer angled surface 123 of the outer ring 122 of the anti-extrusion rings 102 and the inner angled surface 109 of the gauge ring 108 slide relative to one another such that the outer ring 122 expands radially outward from the mandrel 104 and moves toward the separator 110. Similarly, when the force is applied to the anti-extrusion rings 102 by the gauge ring 108, the outer angled surface 113 of the force ring 112 and the inner angled surface 121 of the inner ring 120 of the anti-extrusion rings 102 slide relative to one another such that the inner ring 120 expands radially outward from the mandrel 104 and moves toward the separator 110. As the inner ring 120 and the outer ring 122 expand radially outward, the spring 124 expands radially outward with the inner ring 120 and the outer ring 122. As the spring 124 expands radially outward, the spring 124 is loaded with a force directed toward the mandrel 104.

Figure 1D:
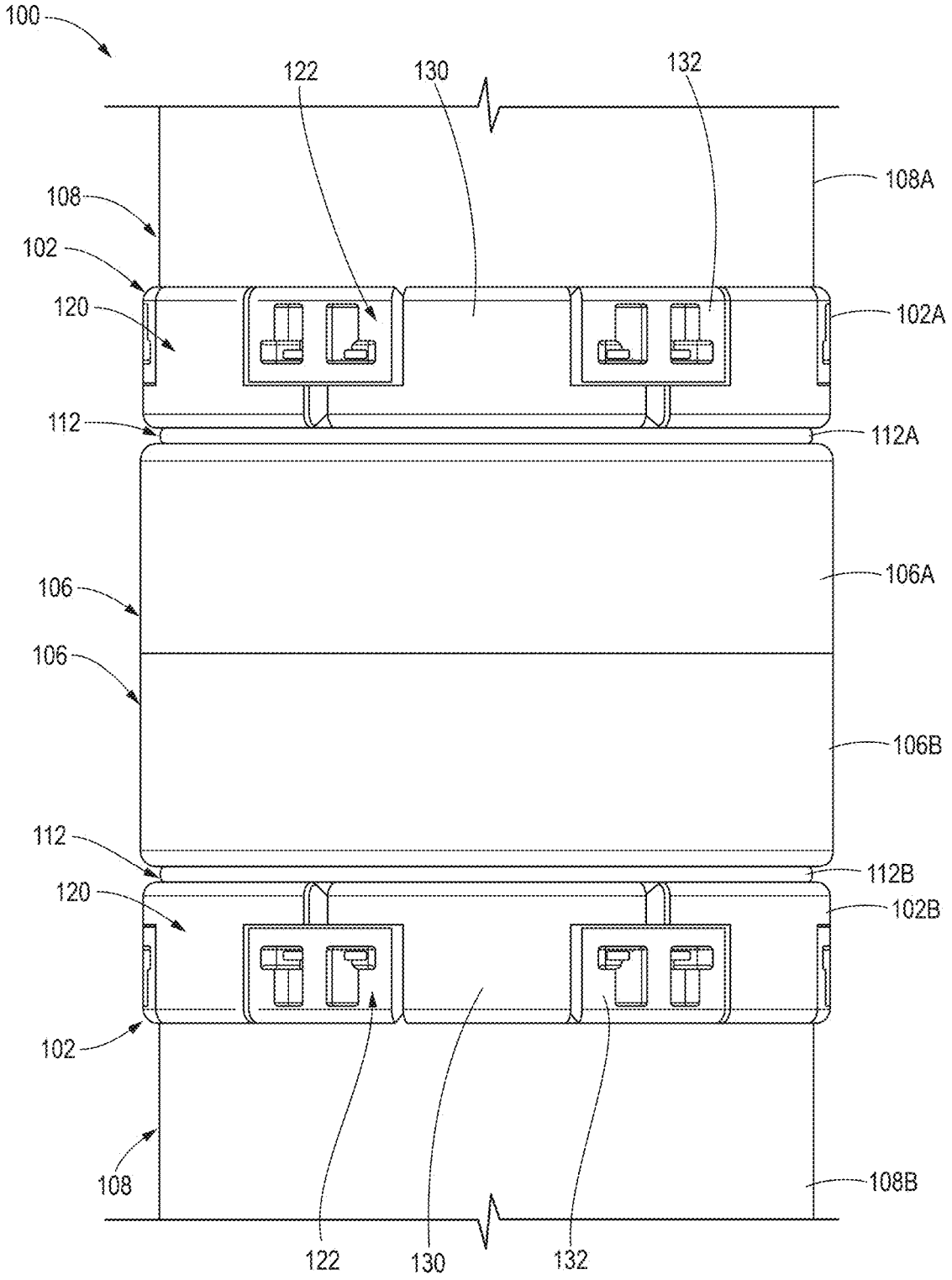
FIG. 1D is a perspective view of a packer assembly having an anti-extrusion ring in a compressed position disposed thereon, according to embodiments herein.
Figure 1E:
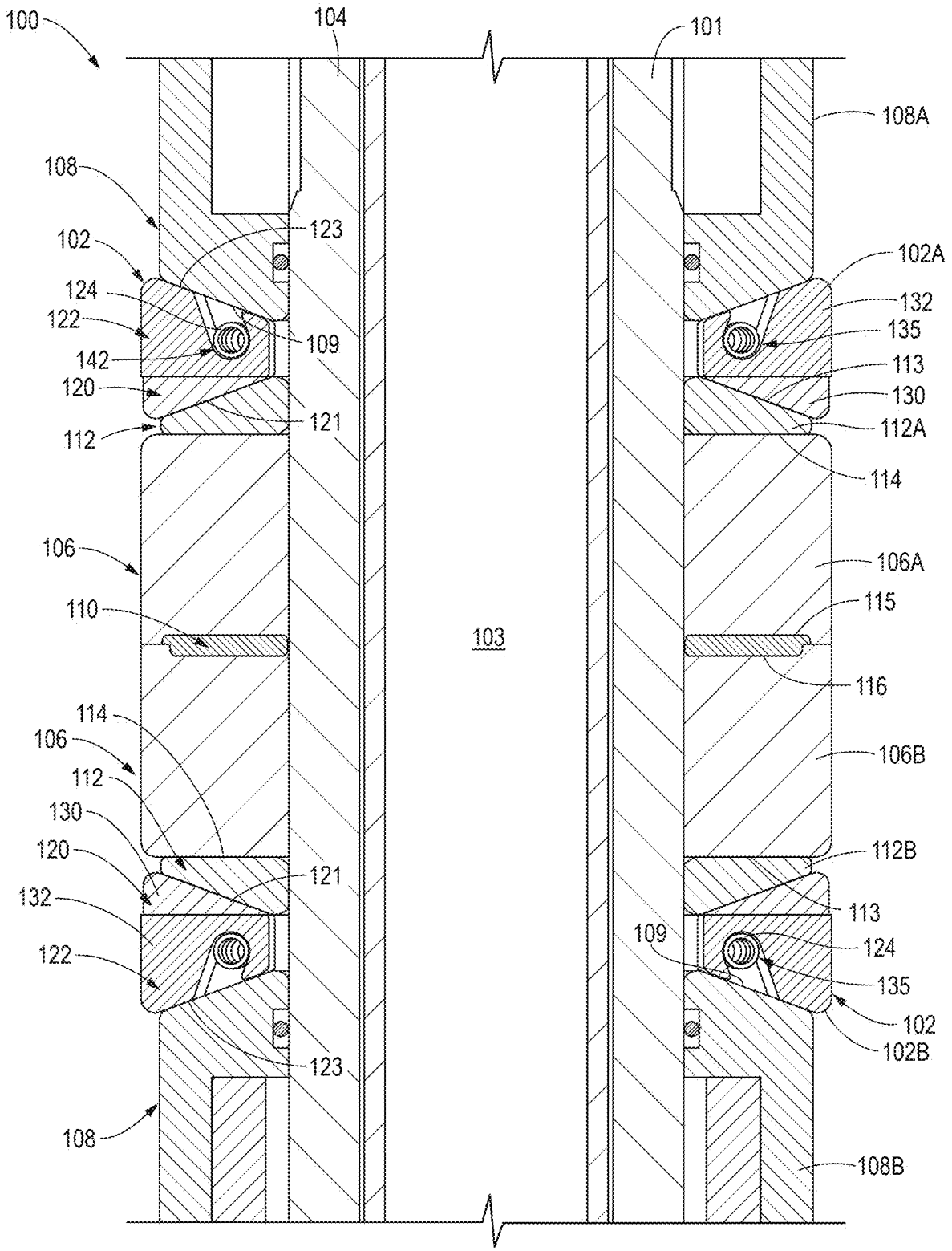
FIG. 1E is a cross-sectional view of a packer assembly having the anti-extrusion ring in the compressed position disposed thereon, according to embodiments herein.

FIG. 1D is a side view of the packer assembly 100 with the anti-extrusion rings 102 in a compressed position. FIG. 1E is a cross-sectional view of the packer assembly 100 as shown in FIG. 1D in the compressed position. The movement of the anti-extrusion ring 102 toward the separator 110 causes the inner portions of the upper packer element 106A and the lower packer element 106B to press against an upper sidewall 115 and a lower sidewall 116, respectively, of the separator 110. Thus, the movement of the anti-extrusion ring 102 toward the separator 110 compresses the packer elements 106. The compression of the packer elements 106 causes the packer elements 106 to expand radially outward. While in the compressed position, the separator 110 is in contact with the adjacent force rings 112. The separator 110 and the inner flat surface 114 of force rings 112 provide a uniform force against the upper packer element 106A and lower packer element 106B as the anti-extrusion rings 102 are moved from the uncompressed position to the compressed position.

To remove the packer system 170 from the wellbore following operations, the force applied to the anti-extrusion rings 102 by the gauge rings 108 is released. The force that was loaded to the spring 124 applies a force toward the mandrel 104 to contract the inner rings 120 and outer rings 122 toward the mandrel 104. The contraction of the anti-extrusion rings 102 releases the force from the force rings 112 on the upper packer element 106A and the lower packer element 106B. The upper packer element 106A and lower packer element 106B are uncompressed and contract radially inward toward the mandrel 104.

Figure 2A:
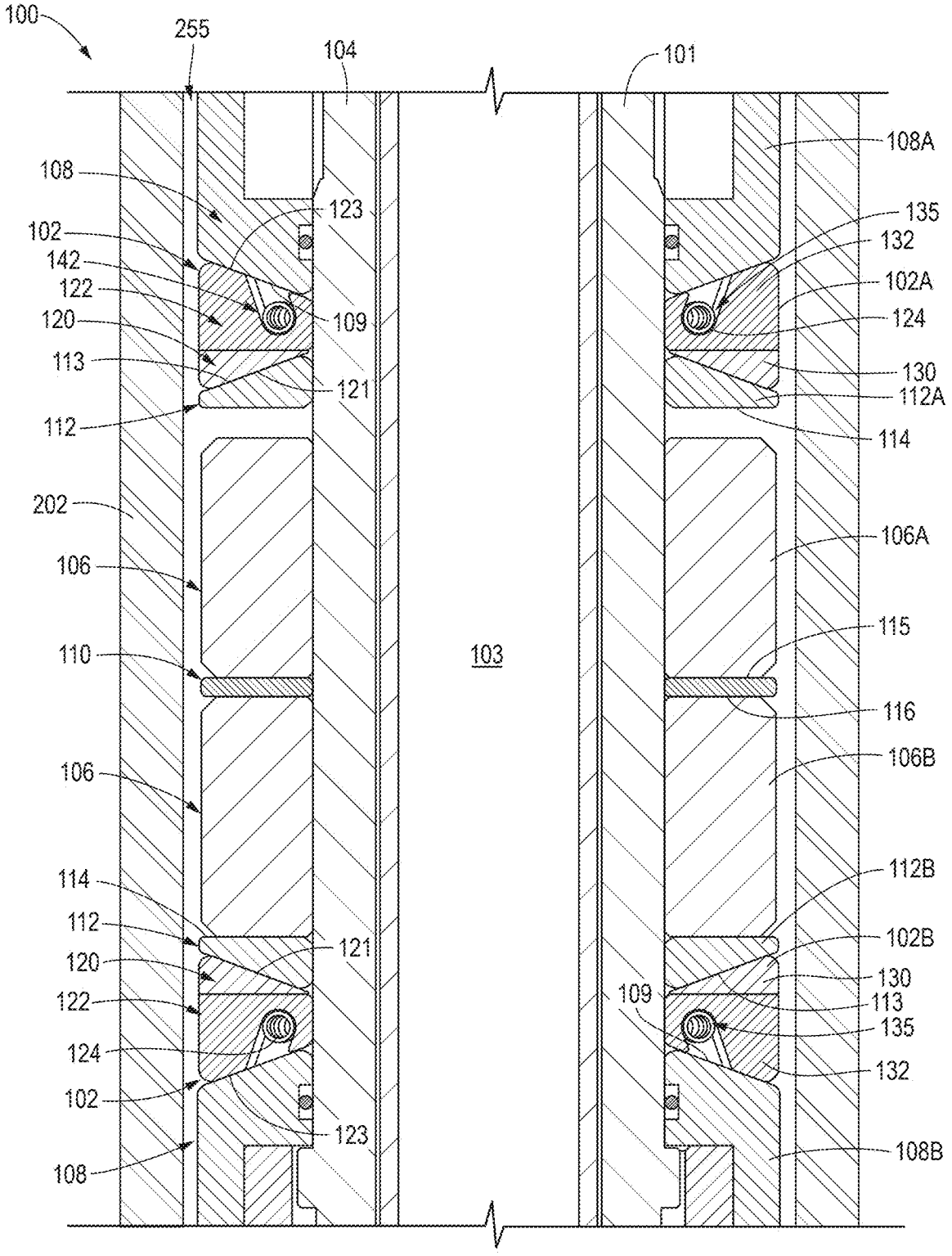
FIG. 2A is a cross-sectional view of a packer assembly having an anti-extrusion ring in the uncompressed position disposed thereon within a casing, according to embodiments herein.
Figure 2B:
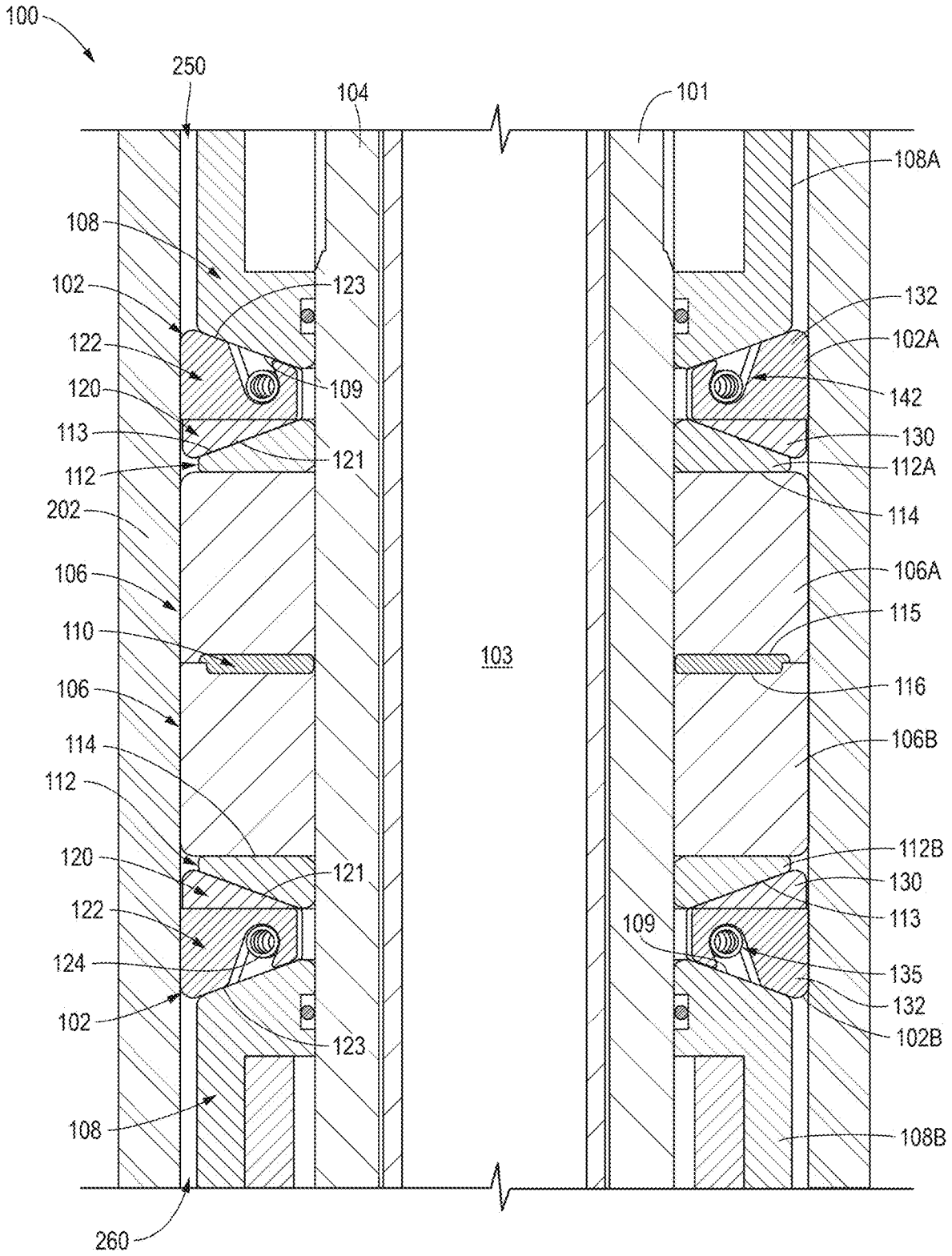
FIG. 2B is a cross-sectional view of a packer assembly having the anti-extrusion ring in the compressed position disposed thereon within the casing, according to embodiments herein.

FIG. 2A is a cross-sectional view of the packer assembly 100 having the anti-extrusion rings 102 in the uncompressed position disposed downhole in a casing 202. FIG. 2B is a cross-sectional view of the packer assembly 100 of FIG. 2A having the anti-extrusion rings 102 in the compressed position. The casing 202 annularly surrounds the packer assembly 100, forming an outer volume 255. While in the uncompressed position, the packer assembly 100 is able to be deployed downhole within the casing 202.

In the compressed position, the compression of the upper packer element 106A and the lower packer element 106B radially outward to form a seal against the casing 202 between an upper zone 250 of the outer volume 255 and a lower zone 260 of the outer volume 255. The seal prevents fluid flow from the lower zone 260 to the upper zone 250. As the anti-extrusion rings 102 expand radially outward from the uncompressed position to the compressed position, the inner angled surfaces 121 of the inner rings 120 provides a uniform force to the upper packer element 106A and lower packer element 106B as the upper packer element 106A and lower packer element 106B are compressed radially past the separator 110 and the force rings 112. The radially outward movement of the anti-extrusion rings 102 prevents the upper packer element 106A and lower packer element 106B from extruding past the gauge rings 108 and, ultimately, failing while subjected to large forces. Failure of the packer elements may cause a disruption of the seal, leading to fluid flow from the lower zone 260 to the upper zone 250. Failure of the anti-extrusion rings 102 may further result in pieces of the anti-extrusion ring 102 falling downhole, making the pieces of the anti-extrusion rings 102 irretrievable, and thus hampering the retrievability of the packer elements.

After the completion of the downhole operations requiring deployment of the packer system 170, the force applied to the anti-extrusion rings 102 by the gauge rings 108 is released. The force that was loaded to the spring 124 applies a force toward the mandrel 104 to contract the inner rings 120 and outer rings 122 toward the mandrel 104. The contraction of the anti-extrusion rings 102 releases the force from the force rings 112 on the upper packer element 106A and the lower packer element 106B. The upper packer element 106A and lower packer element 106B are uncompressed and contract radially inward toward the mandrel 104. The uncompressing of the upper packer element 106A and the lower packer element 106B enable the packer elements to be removed from the casing 202.

Figure 3A:
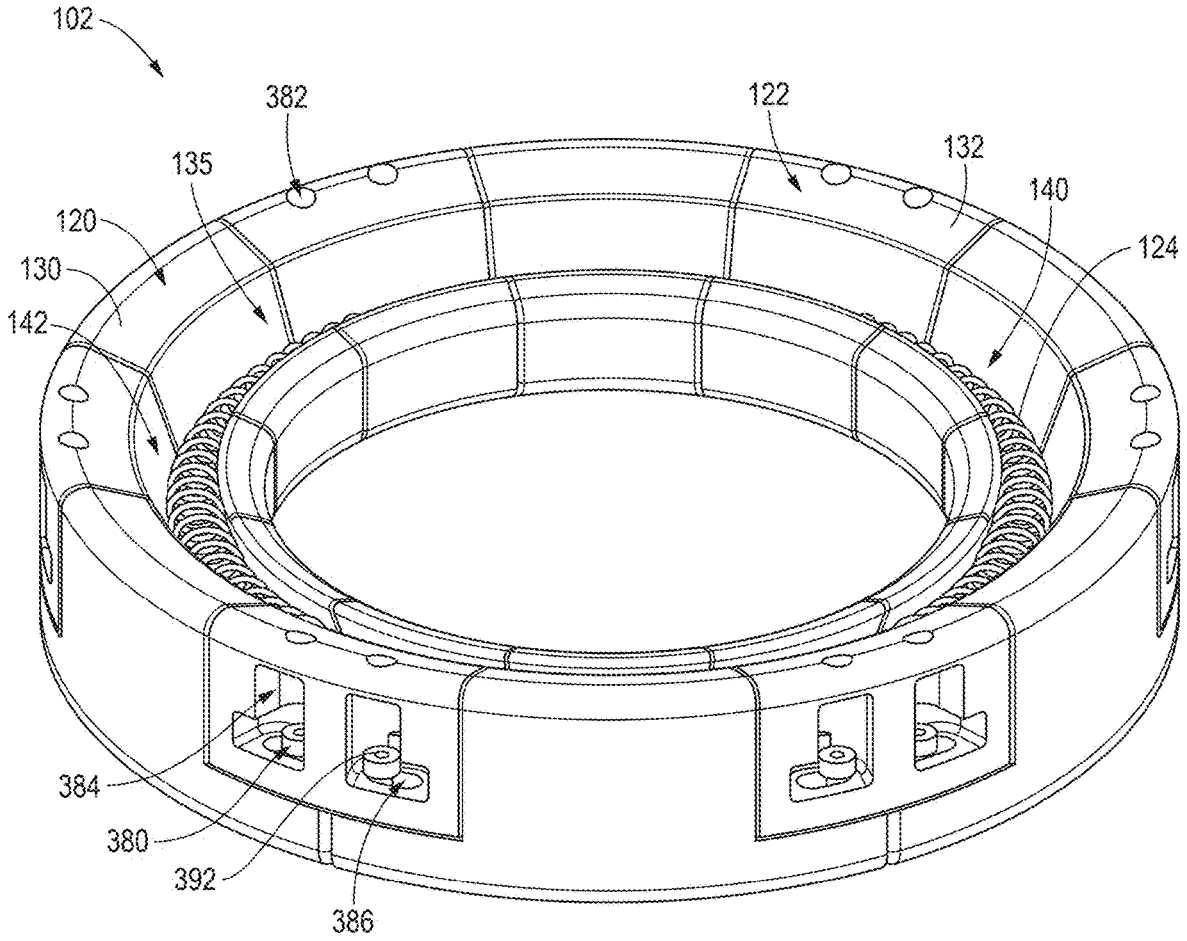
FIG. 3A is a perspective view of an anti-extrusion ring in an uncompressed position, according to embodiments herein.
Figure 3B:
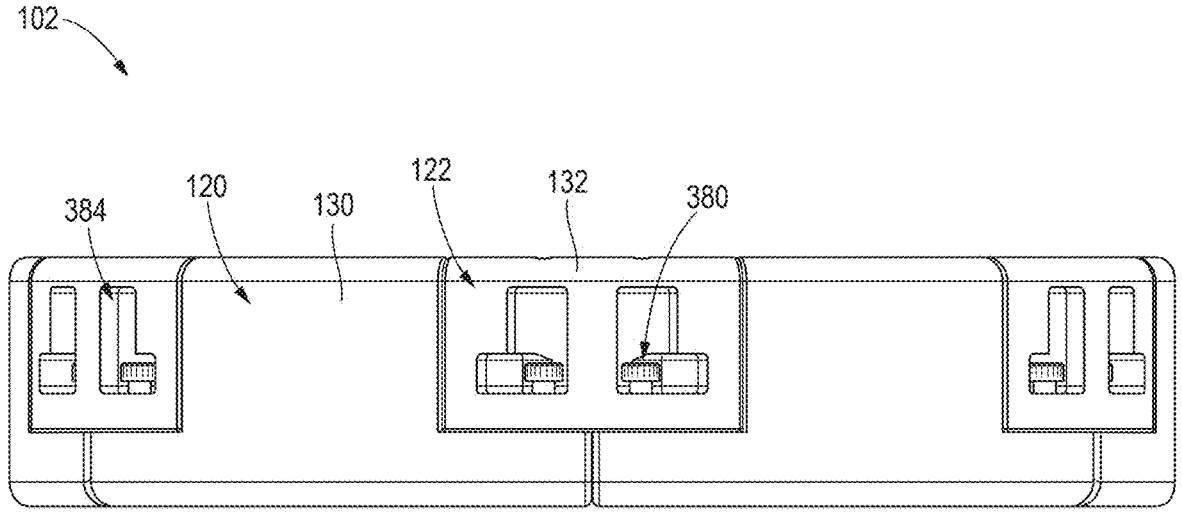
FIG. 3B is a side view of an anti-extrusion ring in an uncompressed position, according to embodiments herein.
Figure 3C:
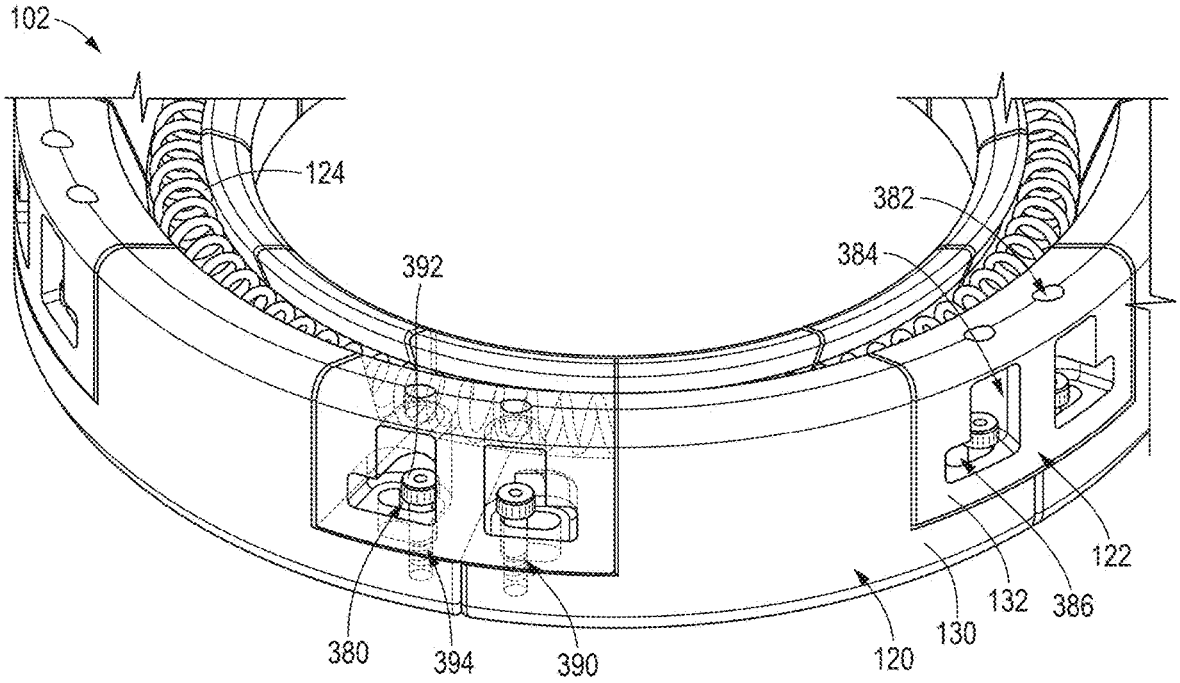
FIG. 3C is a perspective view, including a partially transparent portion of an anti-extrusion ring, according to embodiments herein.
Figure 3D:
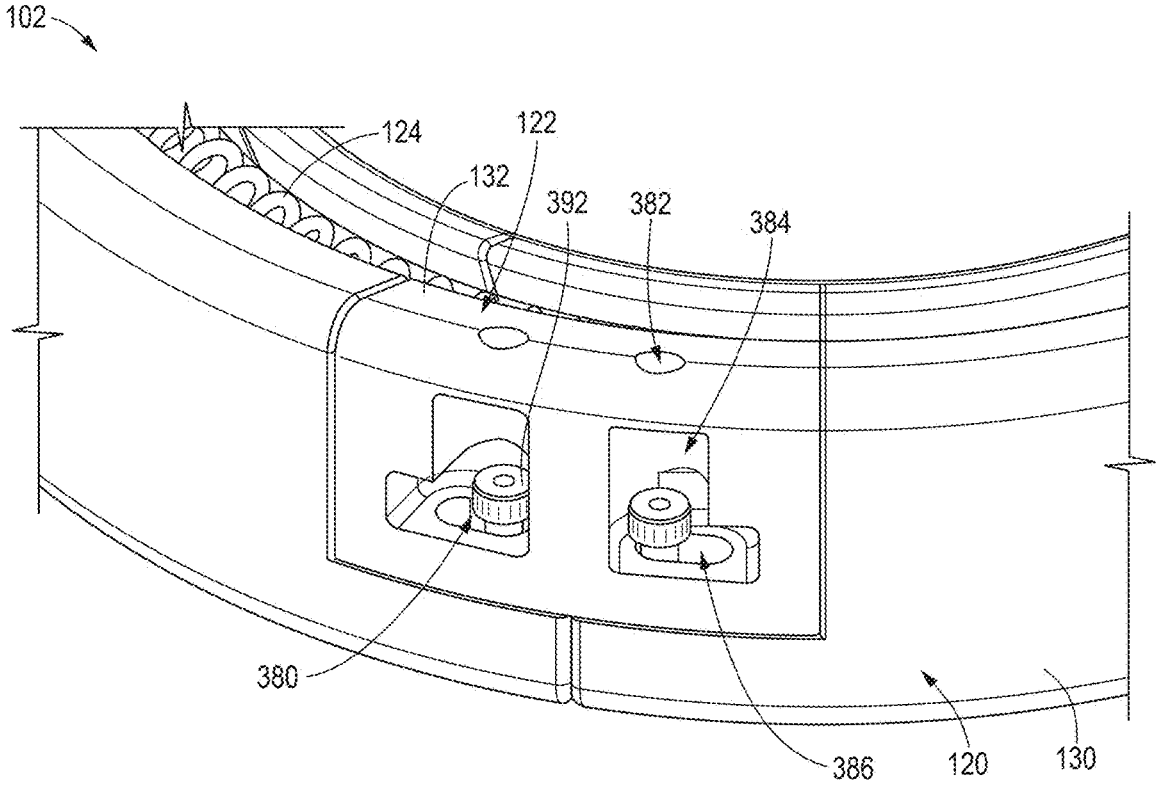
FIG. 3D is a partial perspective view of a retention groove of an anti-extrusion ring, according to embodiments herein.

FIG. 3A is a perspective view of an anti-extrusion ring 102 in the uncompressed position. FIG. 3B is a side view of the anti-extrusion ring 102 in the uncompressed position. FIG. 3C is a perspective view of a partially transparent portion of the anti-extrusion ring 102. FIG. 3D is a perspective view of the retention groove 384 of the anti-extrusion ring 102. The anti-extrusion ring 102 further includes a retention bolt 380. Each outer ring segment 132 of the outer ring 122 further comprises a retention bolt receiver 382, a retention groove 384, and a retention bolt expansion channel 386. The retention bolt 380 includes a bolt head 392 and a threaded connection end 394 distal from the bolt head 392. The bolt head 392 is sized to be larger than the retention bolt expansion channel 386, such that the bolt head 392 is prevented from entering the retention bolt expansion channel 386. The retention bolt receiver 382 is a circular opening in the outer angled surface 123 of the outer ring 122 of the anti-extrusion ring 102. The retention groove 384 is a L-shaped cavity within the outer ring 122 of the anti-extrusion ring 102 and is open on the sidewall of the outer ring 122. The retention bolt expansion channel 386 is an oblong oval passage in a bottom surface of the retention groove 384. The retention bolt receiver 382 is configured to enable the retention bolt 380 to enter the retention groove 384 and the retention bolt expansion channel 386. The retention bolt receiver 382, the retention groove 384, and the retention bolt expansion channel 386 being incorporated into the outer ring 122 reduces the number of pathways through which packer element extrusion may occur, as the outer ring 122 is not in direct contact with the packer elements 106.

The retention bolt expansion channel 386 enables the radially outward expansion of the anti-extrusion ring 102 during the transition of the anti-extrusion ring from the uncompressed position to the compressed position. As the force is applied by the gauge rings 108 to the anti-extrusion ring 102, and the anti-extrusion ring 102 expands radially outward, the retention bolt 380 moves within the retention bolt expansion channel 386 to facilitate the radially outward expansion of the anti-extrusion ring 102, while maintaining the connection between the inner ring 120 and the outer ring 122.

Each inner ring segment 130 of the inner ring 120 includes a retention bolt connector 390. The retention bolt expansion channel 386 is configured to receive the retention bolt 380 via the retention bolt receiver 382. The retention bolt expansion channel 386 is formed in the outer ring segment 132 such that the retention bolt 380 extends through the outer ring segment 132 via the retention bolt expansion channel 386. The retention bolt connector 390 of the inner ring segment 130 is threaded and couples to the threaded connection end 394 of the retention bolt 380. It is to be noted that other connection types could be employed and are contemplated herein. The connection end 394 being coupled to the retention bolt connector 390, in conjunction with the bolt head 392 being sized larger than the retention bolt expansion channel 386, couples the inner ring segment 130 to the outer ring segment 132 (and, consequently, couples the inner ring 120 to the outer ring 122). Coupling the inner ring 120 to the outer ring 122 enables the retention of all components of the anti-extrusion ring 102 in the event of a spring failure. Thus, a spring failure does not result in pieces of the anti-extrusion ring 102 falling downhole, thereby making the pieces of the anti-extrusion ring 102 irretrievable and hampering the retrievability of the packet elements.

The inner ring 120 includes a lower generally smooth surface (e.g., inner angled surface 121) to contact the force rings 112 and the packer elements 106 to the extent they expand and contract the inner ring 120. As a result, the inner angled surface 121 has few or no pathways through which extrusion of the packer elements 106 can occur, thus decreasing the likelihood of packer elements 106 failure.

Figure 4A:
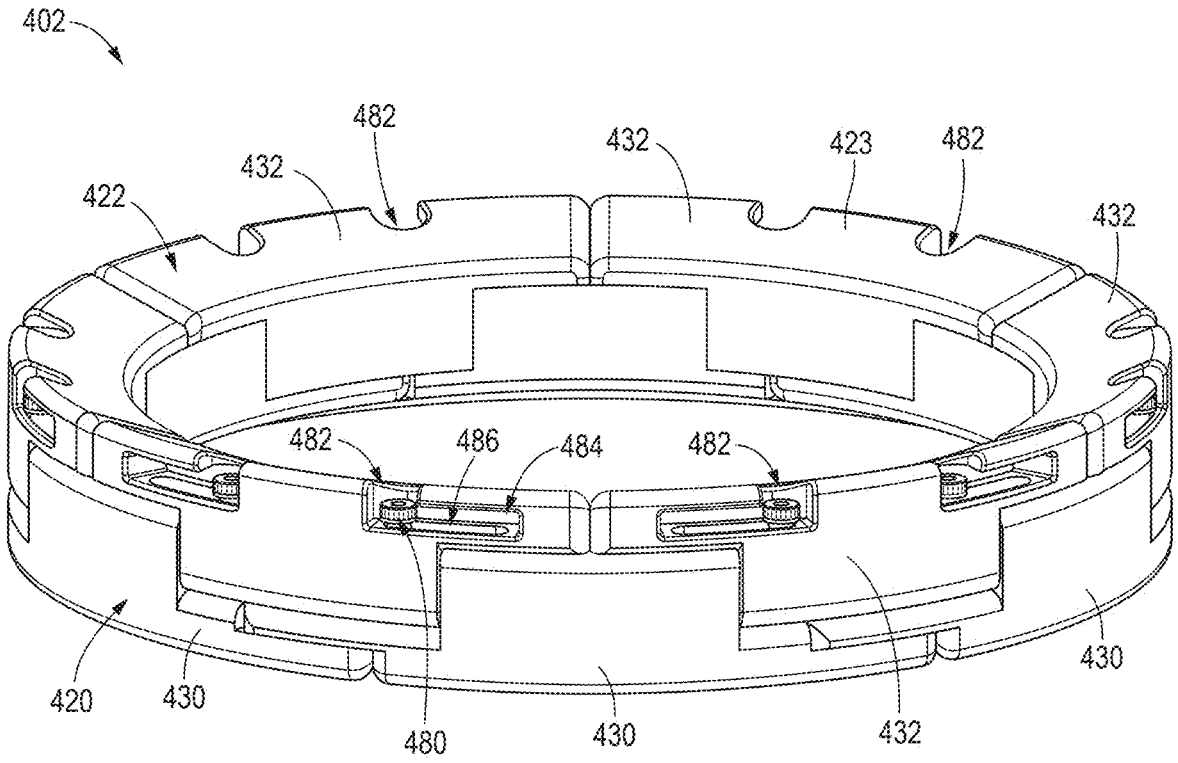
FIG. 4A is a perspective view of an anti-extrusion ring in an uncompressed position, according to embodiments herein.
Figure 4B:
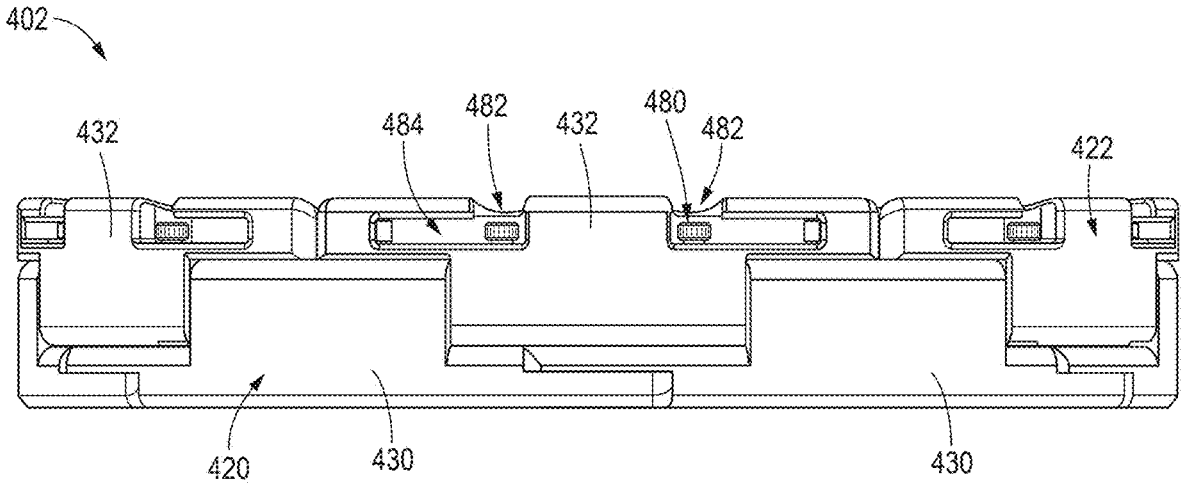
FIG. 4B is a side view of an anti-extrusion ring in an uncompressed position, according to embodiments herein.
Figure 4C:
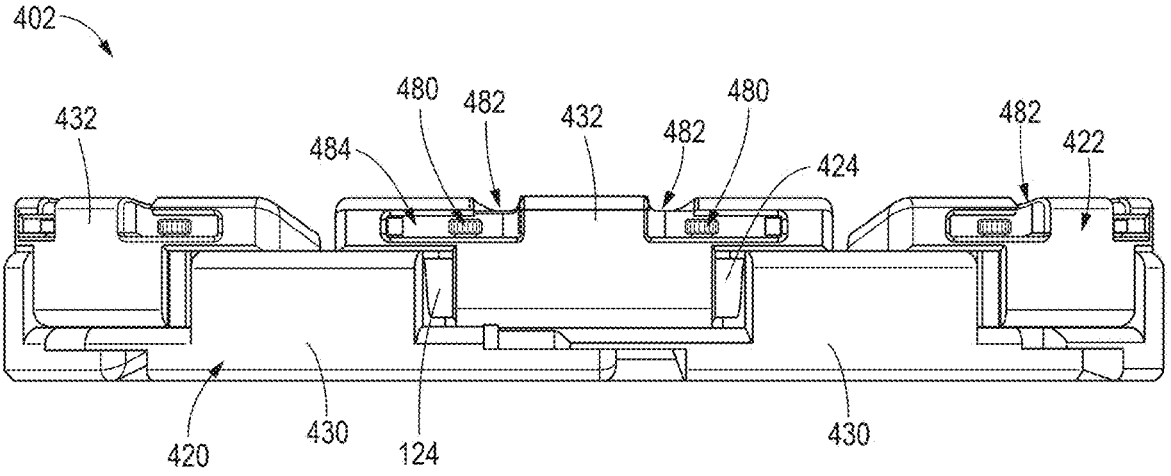
FIG. 4C is a side view of an anti-extrusion ring in a compressed position, according to embodiments herein.
Figure 4D:
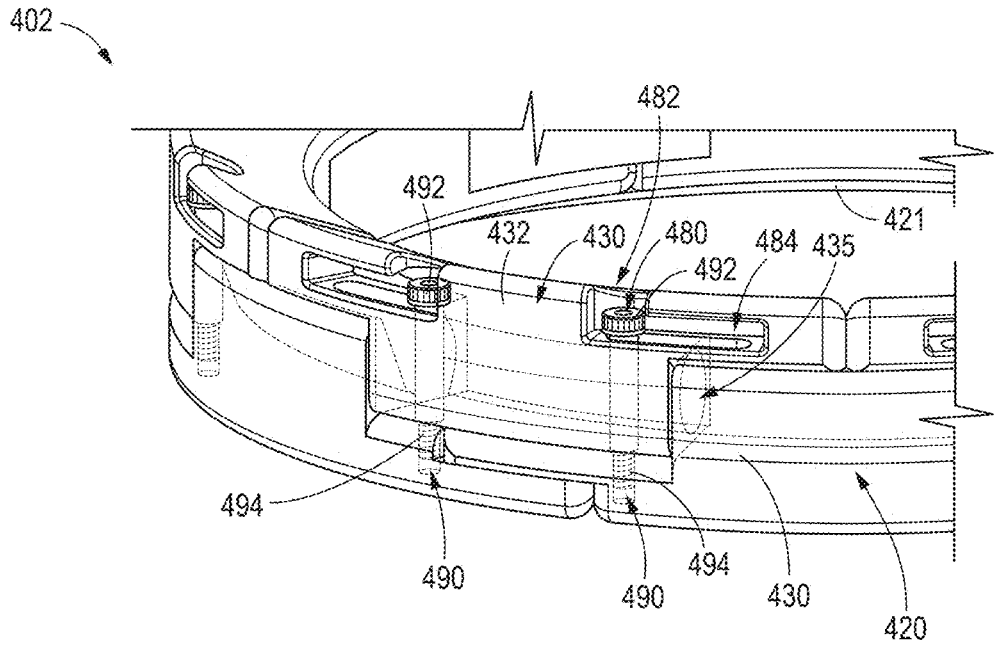
FIG. 4D is a perspective view, including a partially transparent portion of an anti-extrusion ring, according to embodiments herein.
Figure 4E:
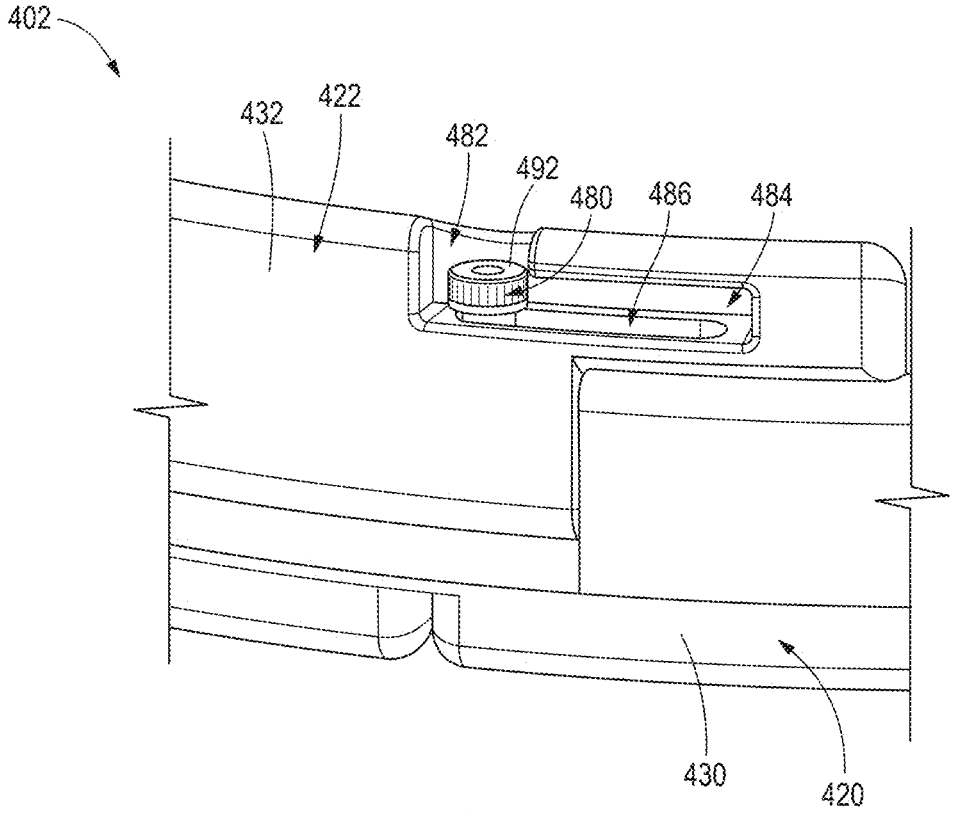
FIG. 4E is a partial perspective view of a retention groove of an anti-extrusion ring, according to embodiments herein.
Figure 4F:
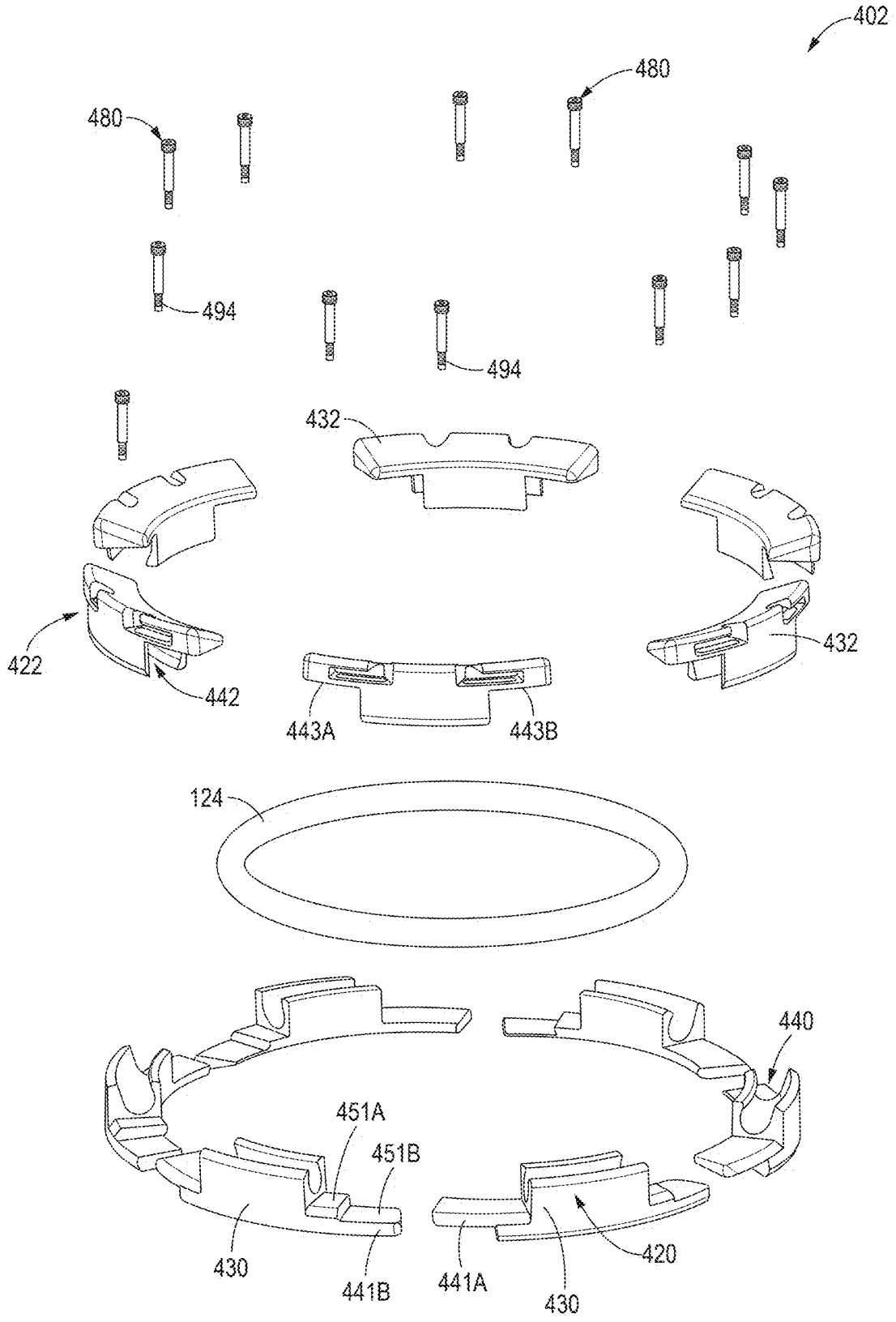
FIG. 4F is an exploded perspective view of an anti-extrusion ring, according to embodiments herein.

FIG. 4A is a perspective view of an anti-extrusion ring 402 in the uncompressed position. FIG. 4B is a side view of the anti-extrusion ring 402 in the uncompressed position. FIG. 4C is a side view of the anti-extrusion ring 402 in a compressed position. FIG. 4D is a perspective view of a partially transparent portion of the anti-extrusion ring 402. FIG. 4E is a perspective view of the retention groove 484 of the anti-extrusion ring 402. FIG. 4F is a perspective, exploded view of the anti-extrusion ring 402. The anti-extrusion ring 402 may be used in the packer system 170 in place of the anti-extrusion ring 102.

The anti-extrusion ring 402 includes an inner ring 420 (e.g., a first ring), an outer ring 422 (e.g., a second ring), and a spring 124. The anti-extrusion ring 402 circumferentially surrounds the mandrel 104. The inner ring 420 includes a plurality of inner ring segments 430 and the outer ring 422 includes a plurality of outer ring segments 432. Each inner ring segment 430 includes an inner ring segment spring channel 440 and each outer ring segment 432 includes an outer ring segment spring channel 442. A spring channel 435 is formed from a plurality of the inner ring segment spring channels 440 and the plurality of the outer ring segment spring channels 442. When assembled, the inner ring segment spring channels 440 and the outer ring segment spring channels 442 are aligned to form the spring channel 435. The spring channel 435 surrounds (e.g., fully contains) the spring 424. The spring channel 435 houses the spring 124 and protects the spring 124 from contamination under production conditions, e.g., the spring channel 435 prevents potential spring failure due to debris intrusion.

The anti-extrusion ring 402 further includes a retention bolt 480. Each outer ring segment 432 of the outer ring 422 further comprises a retention bolt receiver 482, a retention groove 484, and a retention bolt expansion channel 486. The retention bolt 480 includes a bolt head 492 and a threaded connection end 494 distal from the bolt head 492. The bolt head 492 is sized to be larger than the retention bolt expansion channel 486, such that the bolt head 492 is prevented from entering the retention bolt expansion channel 486. The retention bolt receiver 482 is a semi-circular opening in the outer angled surface 423 of the outer ring 422 of the anti-extrusion ring 402. The retention groove 484 is a cavity within the outer ring 422 of the anti-extrusion ring 402 and is open along the length of the cavity on the sidewall of the outer ring 422. The retention bolt expansion channel 486 is an oblong oval passage in a bottom surface of the retention groove 484. The retention bolt receiver 482 is configured to enable the retention bolt 480 to enter the retention groove 484 and the retention bolt expansion channel 486. The retention bolt receiver 482, the retention groove 484, and the retention bolt expansion channel 486 being incorporated into the outer ring 422 reduces the number of pathways through which packer element extrusion may occur, as the outer ring 422 is not in direct contact with the packer elements.

The retention bolt expansion channel 486 enables the radially outward expansion of the anti-extrusion ring 402 during the transition of the anti-extrusion ring from the uncompressed position to the compressed position. As the force is applied by the gauge rings 108 to the anti-extrusion ring 402, and the anti-extrusion ring 402 expands radially outward, the retention bolt 480 moves within the retention bolt expansion channel 486 to facilitate the radially outward expansion of the anti-extrusion ring 402, while maintaining the connection between the inner ring 420 and the outer ring 422.

Each inner ring segment 430 of the inner ring 420 includes a retention bolt connector 490. The retention bolt expansion channel 486 is configured to receive the retention bolt 480 via the retention bolt receiver 482. The retention bolt expansion channel 486 is formed in the outer ring segment 432 such that the retention bolt 480 extends through the outer ring segment 432 via the retention bolt expansion channel 486. The retention bolt connector 490 of the inner ring segment 430 is threaded and couples to the threaded connection end 494 of the retention bolt 480. It is to be noted that other connection types could be employed and are contemplated herein. The connection end 494 being coupled to the retention bolt connector 490, in conjunction with the bolt head 492 being sized larger than the retention bolt expansion channel 486, couples the inner ring segment 430 to the outer ring segment 432 (and, consequently, couples the inner ring 420 to the outer ring 422). Coupling the inner ring 420 to the outer ring 422 enables the retention of all components of the anti-extrusion ring 402 in the event of a spring failure. Thus, a spring failure does not result in pieces of the anti-extrusion ring 402 falling downhole, thereby making the pieces of the anti-extrusion ring 402 irretrievable and hampering the retrievability of the packet elements.

The inner ring 420 includes a lower generally smooth surface (e.g., inner angled surface 421) to contact the force rings 112 and the packer elements 106 to the extent they expand and contract the inner ring 420. As a result, the inner angled surface 421 has few or no pathways through which extrusion of the packer elements 106 can occur, thus decreasing the likelihood of packer elements 106 failure.

The inner ring 420 further includes a first extension 441A and a second extension 441B extending from the inner ring segment spring channel 440, and the outer ring 422 includes a first extension 443A and second extension 443B. The second extension 441B includes a raised portion 451A and a lower portion 451B. The first extension 441A of the inner ring 420 and the second extension 441B of an adjacent inner ring 420 are configured to fit together to form the lower generally smooth surface (e.g., inner angled surface 421). To form the lower generally smooth surface (e.g., inner angled surface 421), the first extension 441A is disposed over the lower portion 451B of the second extension 441B such that the upper surface of the lower portion 451B is in contact with the lower surface of the first extension 441A. The upper surface of the first extension 441A is substantially coplanar with the upper surface of the raised portion 451A of the second extension 441B.

Figure 5:
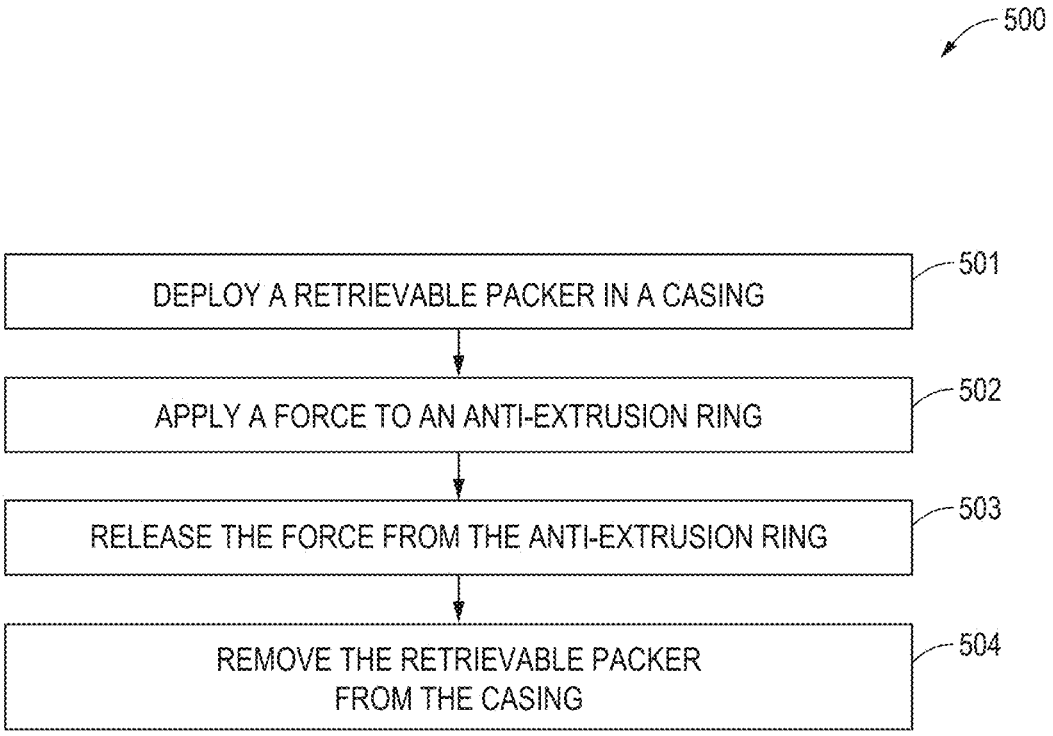
FIG. 5 is a flow diagram of a method of deploying a packer system with an anti-extrusion ring, according to embodiments herein.

FIG. 5 is a flow diagram of a method 500 of using the packer assembly 100 and anti-extrusion rings 102. At operation 501, a packer assembly 100 is deployed downhole. While the method 500 is described with respect to anti-extrusion ring 102, the anti-extrusion ring 402 may be used in the method 500.

At operation 501, the packer assembly 100 is in an uncompressed position, allowing for the packer assembly 100 to be easily deployed into the wellbore and production casing 202 or other tubular. At operation 502, a force is applied to the anti-extrusion rings 102 by the gauge rings 108. An inner angled surface 109 of the gauge ring 108 applies the force to the outer angled surface 123 of an outer ring 122 of the anti-extrusion ring 102. The force is further transferred to an interface between an inner angled surface 121 of an inner ring 120 of the anti-extrusion rings 102 and an outer angled surface 113 of the force ring 112. The force compresses the packer elements 106A and 106B using the force rings 112 and the separator 110.

The force causes the anti-extrusion rings 102 and the packer elements expand radially outward. As the gauge rings 108 apply the force toward the separator 110, the outer angled surface 123 of the outer ring 122 of the anti-extrusion ring 102 and the inner angled surface 109 of the gauge ring 108 slide relative to one another such that the outer ring 122 expands radially outward. Similarly, the outer angled surface 113 of the force ring 112 and the inner angled surface 121 of the inner ring 120 of the anti-extrusion ring 102 slide relative to one another such that the inner ring 120 expands radially outward. The movement of the anti-extrusion rings 102 toward the separator 110 compresses the packer elements. The compression of the packer elements causes the packer elements to expand radially outward.

As the inner ring 120 and the outer ring 122 expand radially outward, a spring 124 of the anti-extrusion ring 102 expands radially outward with the inner ring 120 and the outer ring 122. As the spring 124 expands radially outward, the spring 124 is loaded with a force directed toward the mandrel 104. A retention bolt expansion channel 386 of the outer ring 122 enables the radially outward expansion of the anti-extrusion ring 102 during the transition of the anti-extrusion ring from the uncompressed position to an expanded compressed position. As the force is applied by the gauge rings 108 to the anti-extrusion ring 102, and the anti-extrusion ring 102 expands radially outward, the retention bolt 380 moves within the retention bolt expansion channel 386 to facilitate the radially outward expansion of the anti-extrusion ring 102.

The packer elements form a seal against the outer casing 202 or other tubular. The radially outward expansion of the packer elements forms the seal against the casing 202 or other tubular between an upper zone 250 of the outer volume 255 and a lower zone 260 of the outer volume 255. The seal prevents fluid flow from the lower zone 260 to the upper zone 250. The radially outward movement of the anti-extrusion ring 102 prevents the upper packer element 106A and lower packer element 106B from extruding past the gauge rings 108.

At operation 503, the force is released from the anti-extrusion rings 102. At operation 503, the springs 124 contract the anti-extrusion rings 102 radially inward toward the mandrel 104. The force that was loaded to the springs 124 applies a force toward the mandrel 104 to contract the inner rings 120 and outer rings 122 toward the mandrel 104 and the packer elements are uncompressed. The contraction of the anti-extrusion ring releases the force from the force rings 112 on the packer elements. The packer elements are uncompressed and contract radially inward toward the mandrel 104. At operation 504, the packer assembly 100 is removed from the casing 202.

In summation, a packer assembly having an anti-extrusion ring is disclosed. The anti-extrusion ring includes a first ring comprising a plurality of first ring segments, a second ring comprising a plurality of second ring segments, a spring disposed in a spring channel, and a plurality of retention bolts. Each first ring segment of the plurality of first ring segments includes an first ring segment spring channel and a retention bolt connector. Each second ring segment of the second ring segments includes a second ring segment spring channel and a retention bolt expansion channel formed through the second ring. The spring channel includes the first ring segment spring channels and the second ring segment spring channels. The retention bolts are disposed in the retention bolt expansion channel and coupled to the retention bolt connector. The retention bolt expansion channel enables the radially outward expansion of the anti-extrusion ring during the transition of the anti-extrusion ring from the uncompressed position to the compressed position. Coupling the inner ring to the outer ring via the retention bolts enables the retention of all components of the anti-extrusion ring in the event of a spring failure. Thus, a spring failure does not result in pieces of the anti-extrusion ring falling downhole, thereby making the pieces of the anti-extrusion ring irretrievable and hampering the retrievability of the packet elements.

The term "comprises" and grammatical equivalents thereof are used herein to mean that other components, ingredients, operations, etc. are optionally present. For example, an article "comprising" (or "which comprises") components A, B, and C can consist of (i.e., contain only) components A, B, and C, or can contain not only components A, B, and C but also one or more other components. In addition, whenever a composition, an element or a group of elements is preceded with the transitional phrase "comprising" or grammatical equivalents thereof, it is understood that it is contemplated that the same composition or group of elements may be preceded with transitional phrases "consisting essentially of," "consisting of," "selected from the group of consisting of," or "is" preceding the recitation of the composition, element, or elements and vice versa.

Where reference is made herein to a method comprising two or more defined operations, the defined operations can be carried out in any order or simultaneously (except where the context excludes that possibility), and the method can include one or more other operations which are carried out before any of the defined operations, between two of the defined operations, or after all of the defined operations (except where the context excludes that possibility).

When introducing elements of the present disclosure or exemplary aspects or implementation(s) thereof, the articles "a," "an," "the" and "said" are intended to mean that there are one or more of the elements.

The terms "comprising," "including" and "having" are intended to be inclusive and mean that there may be additional elements other than the listed elements.

While the foregoing is directed to implementations of the present disclosure, other and further implementations of the disclosure may be devised without departing from the basic scope thereof, and the scope thereof is determined by the claims that follow.

What is claimed is:

1. An anti-extrusion ring, comprising:
- a first ring comprising a plurality of first ring segments, each first ring segment of the plurality of first ring segments comprising:
  - a first ring segment spring channel; and
  - a retention bolt connector;
- a second ring comprising a plurality of second ring segments, each second ring segment of the second ring segments comprising:
  - a second ring segment spring channel; and
  - a retention bolt expansion channel formed through the second ring; and
- a spring disposed in a spring channel, wherein the spring channel comprises the first ring segment spring channel and the second ring segment spring channel; and
- a plurality of retention bolts disposed in the retention bolt expansion channel and coupled to the retention bolt connector.

2. The anti-extrusion ring of claim 1, wherein the retention bolt expansion channel enables a radially outward expansion of the anti-extrusion ring.

3. The anti-extrusion ring of claim 2, wherein the plurality of retention bolts further comprise:
- a bolt head; and
- a connection end distal from the bolt head, wherein the connection end is coupled to the retention bolt connector.

4. The anti-extrusion ring of claim 3, wherein the bolt head is sized to be larger than the retention bolt expansion channel.

5. The anti-extrusion ring of claim 1, wherein the spring channel fully contains the spring.

6. A packer assembly, comprising:
- a tubular body;
- a mandrel circumferentially surrounding the tubular body;
- a gauge ring;
- an anti-extrusion ring, wherein the anti-extrusion ring comprises:
  - a first ring comprising a plurality of first ring segments, each first ring segment of the plurality of first ring segments comprising:
    - a first ring segment spring channel; and
    - a retention bolt connector;
  - a second ring comprising a plurality of second ring segments, each second ring segment of the second ring segments comprising:
    - a second ring segment spring channel; and
    - a retention bolt expansion channel formed through the second ring; and
  - a spring disposed in a spring channel, wherein the spring channel comprises the first ring segment spring channel and the second ring segment spring channel; and
  - a plurality of retention bolts disposed in the retention bolt expansion channel and coupled to the retention bolt connector;
- a force ring; and
- a packer element.

7. The packer assembly of claim 6, wherein the retention bolt expansion channel enables a radially outward expansion of the anti-extrusion ring.

8. The packer assembly of claim 7, wherein the plurality of retention bolts further comprises:
- a bolt head; and
- a connection end distal from the bolt head, wherein the connection end is coupled to the retention bolt connector.

9. The packer assembly of claim 8, wherein the bolt head is sized to be larger than the retention bolt expansion channel.

10. The packer assembly of claim 6, wherein the spring channel fully contains the spring.

11. A method, comprising:
- deploying a packer system comprising a packer assembly in a casing; and
- applying a force to an anti-extrusion ring of the packer assembly using a gauge ring of the packer assembly, the anti-extrusion ring comprising:
  - a first ring comprising a plurality of first ring segments;
  - a second ring comprising a plurality of second ring segments;
  - a spring disposed in a spring channel; and
  - a retention bolt coupling the first ring and the second ring, comprising:
    - a head; and
    - a connection end distal from the head, wherein the connection end is coupled to a retention bolt connector, wherein applying the force to the anti-extrusion ring expands the anti-extrusion ring and a packer element radially outward and forms a seal against the casing with the packer element.

12. The method of claim 11, further comprising:
- releasing the force from the anti-extrusion ring to uncompress the packer element; and
- removing the packer system from the casing.

13. The method of claim 11, wherein applying the force to the anti-extrusion ring loads the force directed toward a mandrel onto the spring, wherein the anti-extrusion ring circumferentially surrounds the mandrel.

14. The method of claim 12, wherein releasing the force from the anti-extrusion ring unloads the force of the spring to contract the anti-extrusion ring toward a mandrel.

15. The method of claim 11, wherein the plurality of second ring segments further comprise a retention bolt expansion channel, wherein expanding of the anti-extrusion ring is enabled by the retention bolt moving within the retention bolt expansion channel.

16. The method of claim 11, wherein the packer element comprises an elastomeric material.

17. The method of claim 16, wherein the elastomeric material comprises nitrile or hydrogenated nitrile.

18. The method of claim 11, wherein the spring channel fully contains the spring.

19. A method, comprising:
- deploying a packer system comprising a packer assembly in a casing; and
- applying a force to an anti-extrusion ring of the packer assembly using a gauge ring of the packer assembly, the anti-extrusion ring comprising:
  - a first ring comprising a plurality of first ring segments;
  - a second ring comprising a plurality of second ring segments;
  - a spring disposed in a spring channel; and
  - a retention bolt coupling the first ring and the second ring, wherein applying the force to the anti-extrusion ring expands the anti-extrusion ring and a packer element radially outward and forms a seal against the casing with the packer element and wherein when the force is applied to the anti-extrusion ring by the gauge ring, an outer angled surface of a force ring and an inner angled surface of the first ring slide relative to one another such that the first ring expands radially outward and an outer angled surface of the second ring and an inner angled surface of the gauge ring slide relative to one another such that the second ring expands radially outward.

* * * * *